US007637777B1

(12) United States Patent
Trout et al.

(10) Patent No.: US 7,637,777 B1
(45) Date of Patent: Dec. 29, 2009

(54) CONNECTOR ASSEMBLY HAVING A NOISE-REDUCING CONTACT PATTERN

(75) Inventors: David Allison Trout, Lancaster, PA (US); James Lee Fedder, Etters, PA (US); Jeffrey Byron McClinton, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/250,268

(22) Filed: Oct. 13, 2008

(51) Int. Cl.
*H01R 13/648* (2006.01)

(52) U.S. Cl. ..... 439/607.1; 439/941; 439/74

(58) Field of Classification Search ..... 439/607, 439/676, 608, 701, 607.1, 941, 74
See application file for complete search history.

(56) References Cited

U.S. PATENT DOCUMENTS

| | | | |
|---|---|---|---|
| 4,012,095 | A | 3/1977 | Doucet et al. |
| 4,428,632 | A | 1/1984 | Rich |
| 4,895,521 | A | 1/1990 | Grabbe |
| 4,895,522 | A | 1/1990 | Grabbe |
| RE36,065 | E | 1/1999 | Andrews et al. |
| 5,904,581 | A | 5/1999 | Pope et al. |
| 6,027,345 | A | 2/2000 | McHugh et al. |
| 6,083,047 | A | 7/2000 | Paagman |
| 6,116,965 | A | 9/2000 | Arnett et al. |
| 6,231,391 | B1 | 5/2001 | Ramey et al. |
| 6,310,286 | B1 | 10/2001 | Troxel et al. |
| 6,443,745 | B1 | 9/2002 | Ellis et al. |
| 6,461,202 | B2 | 10/2002 | Kline |
| 6,537,087 | B2 | 3/2003 | McNamara et al. |
| 6,551,140 | B2 | 4/2003 | Billman et al. |
| 6,623,280 | B2 | 9/2003 | Oldenburg et al. |
| 6,682,368 | B2 | 1/2004 | Murr et al. |
| 6,695,646 | B1 | 2/2004 | Grabbe |
| 6,699,048 | B2 | 3/2004 | Johnson et al. |
| 6,705,895 | B2 | 3/2004 | Hasircoglu |
| 6,712,620 | B1 | 3/2004 | Li et al. |
| 6,739,910 | B1 | 5/2004 | Wu |
| 6,743,049 | B2 | 6/2004 | Perugini et al. |
| 6,743,057 | B2 | 6/2004 | Davis et al. |
| 6,809,255 | B1 | 10/2004 | Chun |
| 6,875,056 | B1 | 4/2005 | Bianchini et al. |
| 6,899,550 | B2 | 5/2005 | Perugini et al. |
| 6,902,416 | B2 | 6/2005 | Feldman |
| 6,917,525 | B2 | 7/2005 | Mok et al. |
| 6,918,776 | B2 | 7/2005 | Spink |
| 6,932,618 | B1 | 8/2005 | Nelson |
| 6,932,655 | B2 | 8/2005 | Hatterscheid et al. |
| 6,951,482 | B1 | 10/2005 | Miller et al. |
| 7,018,239 | B2 | 3/2006 | Zaderej et al. |

(Continued)

FOREIGN PATENT DOCUMENTS

| | | |
|---|---|---|
| EP | 0459356 | 8/1995 |

*Primary Examiner*—Neil Abrams
*Assistant Examiner*—Phuong Nguyen

(57) ABSTRACT

A connector assembly includes a housing and contacts. The housing extends between mating and mounting interfaces. The mating and mounting interfaces have contact openings in a noise-reducing contact pattern. The contact openings in the pattern are arranged in pairs along respective contact lines. The contact lines of adjacent pairs are transverse to one another. The contacts extend through the contact openings and are arranged in the noise-reducing contact pattern through the housing between the mating and mounting interfaces to reduce at least one of electric noise and cross-talk in signals communicated by the contacts.

19 Claims, 6 Drawing Sheets

U.S. PATENT DOCUMENTS

| | | | |
|---|---|---|---|
| 7,021,945 | B2 | 4/2006 | Perugini et al. |
| 7,086,872 | B2 | 8/2006 | Myer et al. |
| 7,086,913 | B2 | 8/2006 | Myer et al. |
| 7,097,470 | B2 | 8/2006 | Harper |
| 7,207,807 | B2 | 4/2007 | Fogg |
| 7,244,125 | B2 | 7/2007 | Brown et al. |
| 7,262,672 | B2 | 8/2007 | Lee et al. |
| 7,309,239 | B2 | 12/2007 | Shuey et al. |
| 7,390,194 | B1 | 6/2008 | Crippen et al. |
| 7,429,176 | B2 | 9/2008 | Johnescu et al. |
| 7,465,195 | B1 | 12/2008 | Kerrigan et al. |
| 7,470,149 | B2 | 12/2008 | Kazama et al. |
| 2001/0049207 | A1 | 12/2001 | Sakata et al. |
| 2002/0151218 | A1 | 10/2002 | Figueroa et al. |
| 2003/0027439 | A1 | 2/2003 | Johnescu et al. |
| 2003/0064614 | A1 | 4/2003 | Tanaka et al. |
| 2003/0082954 | A1 | 5/2003 | Espenshade et al. |
| 2003/0162442 | A1 | 8/2003 | Panella |
| 2004/0166704 | A1 | 8/2004 | Perugini et al. |
| 2004/0174223 | A1 | 9/2004 | Achyut |
| 2007/0197095 | A1 | 8/2007 | Feldman et al. |
| 2008/0188098 | A1 | 8/2008 | Boesch et al. |
| 2008/0214059 | A1* | 9/2008 | Rothermel et al. ..... 439/701 |
| 2008/0233806 | A1* | 9/2008 | Rothermel et al. ..... 439/676 |

* cited by examiner

CONNECTOR ASSEMBLY HAVING A NOISE-REDUCING CONTACT PATTERN

BACKGROUND OF THE INVENTION

The invention relates generally to electrical connectors and, more particularly, to a connector assembly that mechanically and electrically connects substrates.

Known connectors include a differential signal contact pattern in which contacts in the connectors are arranged in a noise cancelling signal pattern. For example, U.S. Pat. No. 7,207,807 describes a noise cancelling differential connector and footprint of the contacts in the connector. The footprint, or arrangement, of the contacts reduces noise in signals communicated using the contacts. Known connectors that include the noise cancelling contact pattern described in the '807 patent do not maintain the spacing of the contacts relative to one another throughout the connector. For example, the connectors do not maintain the arrangement of the contacts in the noise cancelling pattern throughout the connectors, or between mating and mounting ends of the connectors. The connectors employ jogs, bends, or additional components that change the arrangement of the contacts between the mating and mounting ends of the connectors. For example, the contacts may be arranged in the noise cancelling pattern at a mounting end of the connector, but the arrangement of the contacts with respect to one another differs at the mating end of the connector. If the mating end of the connector is to mate with a mating connector having mating contacts in the noise cancelling contact pattern, one or more jogs, bends or additional components must be added to one of the connectors to align the contacts with the mating contacts.

A need thus exists for a connector that interconnects substrates with contacts in a noise-reducing contact pattern while maintaining the arrangement of the contacts through the connector.

BRIEF DESCRIPTION OF THE INVENTION

In one embodiment, a connector assembly includes a housing and contacts. The housing extends between mating and mounting interfaces. The mating and mounting interfaces have contact openings in a noise-reducing contact pattern. The contact openings in the pattern are arranged in pairs along respective contact lines. The contact lines of adjacent pairs are transverse to one another. The contacts extend through the contact openings and are arranged in the noise-reducing contact pattern through the housing between the mating and mounting interfaces to reduce at least one of electric noise and cross-talk in signals communicated by the contacts.

In another embodiment, a connector assembly includes a header assembly and a mating connector. The header assembly includes a housing and mezzanine contacts. The housing extends between mating and mounting interfaces. The mounting interface is configured to be mounted to one of the substrates. The mating and mounting interfaces have contact openings in a noise-reducing contact pattern. The contact openings in the pattern are arranged in pairs having contact lines. The contact lines of adjacent pairs are transverse to one another. The mezzanine contacts extend through the contact openings and are arranged in the noise-reducing contact pattern through the header assembly between the mating and mounting interfaces to reduce at least one of electric noise and cross-talk in signals communicated by the mezzanine contacts. The mating connector is configured to be mounted to another one of the substrates and to mate with the mating interface of the header assembly. The mating connector includes mating contacts that are arranged in the noise-reducing contact pattern to mate with the mezzanine contacts. The header assembly and the mating connector mate with one another to electrically connect the substrates.

DETAILED DESCRIPTION OF THE INVENTION

Figure 1:
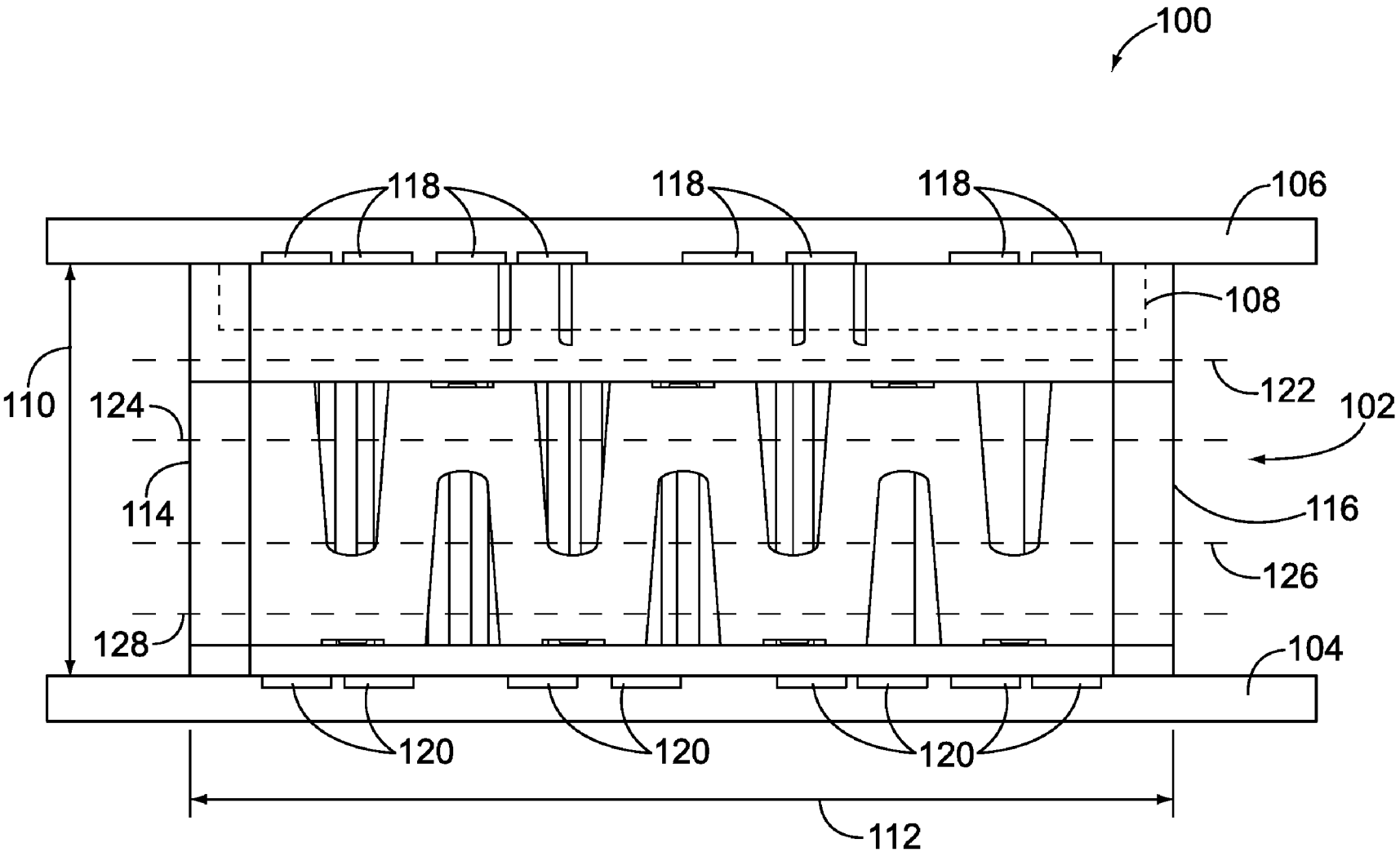
FIG. 1 is an elevational view of a mezzanine connector assembly according to one embodiment.

FIG. 1 is an elevational view of a mezzanine connector assembly 100 according to one embodiment. The connector assembly 100 includes a header assembly 102 that mechanically and electrically connects a plurality of substrates 104, 106 in a parallel arrangement. As shown in FIG. 1, the substrates 104, 106 are interconnected by the header assembly 102 so that the substrates 104, 106 are substantially parallel to one another. The substrates 104, 106 may include circuit boards. For example, a first or lower substrate 104 may be a motherboard and a second or upper substrate 106 may be a daughter board. The daughter board 106 includes conductive pathways 118 and the motherboard 104 includes conductive pathways 120. The conductive pathways 118, 120 communicate data signals and/or electric power between the daughter board 106 and the motherboard 104, and one or more electric components (not shown) that are electrically connected to the daughter board 106 and the motherboard 104. The conductive pathways 118, 120 may be embodied in electric traces in a circuit board. The terms upper and lower are used herein to describe the daughter board 106 and the motherboard 104 but are not intended to limit the scope of the embodiments described herein.

A mating connector 108 is mounted to the daughter board 106 in the illustrated embodiment. The header assembly 102 is mounted to the motherboard 104 and engages the mating connector 108 to electrically and mechanically couple the daughter board 106 and the motherboard 104. Optionally, the mating connector 108 may be mounted to the motherboard 104. Alternatively, the header assembly 102 may directly mount to each of the daughter board 106 and the motherboard 104 to electrically and mechanically couple the daughter board 106 and the motherboard 104. The daughter board 106 and the motherboard 104 may include electrical components (not shown) to enable the connector assembly 100 to perform certain functions. For purposes of illustration only, the connector assembly 100 may be a blade for use in a blade server. It is to be understood, however, that other applications of the inventive concepts disclosed herein also are contemplated.

The header assembly 102 separates the daughter board 106 and the motherboard 104 by a stack height 110. The stack height 110 may be approximately constant over an outer length 112 of the header assembly 102. The outer length 112 extends between opposite ends 114, 116 of the header assembly 102. Alternatively, the stack height 110 may differ or change along the outer length 112 of the header assembly 102. For example, the header assembly 102 may be shaped such that the daughter board 106 and the motherboard 104 are disposed transverse to one another. The stack height 110 may be varied by connecting daughter board 106 and the motherboard 104 using different header assemblies 102 and/or mating connectors 108. The sizes of the header assemblies 102 and/or the mating connectors 108 may vary so that the stack height 110 may be selected by an operator. For example, an operator may select one header assembly 102 and/or mating connector 108 to separate the daughter board 106 and the motherboard 104 by a desired stack height 110.

Figure 2:
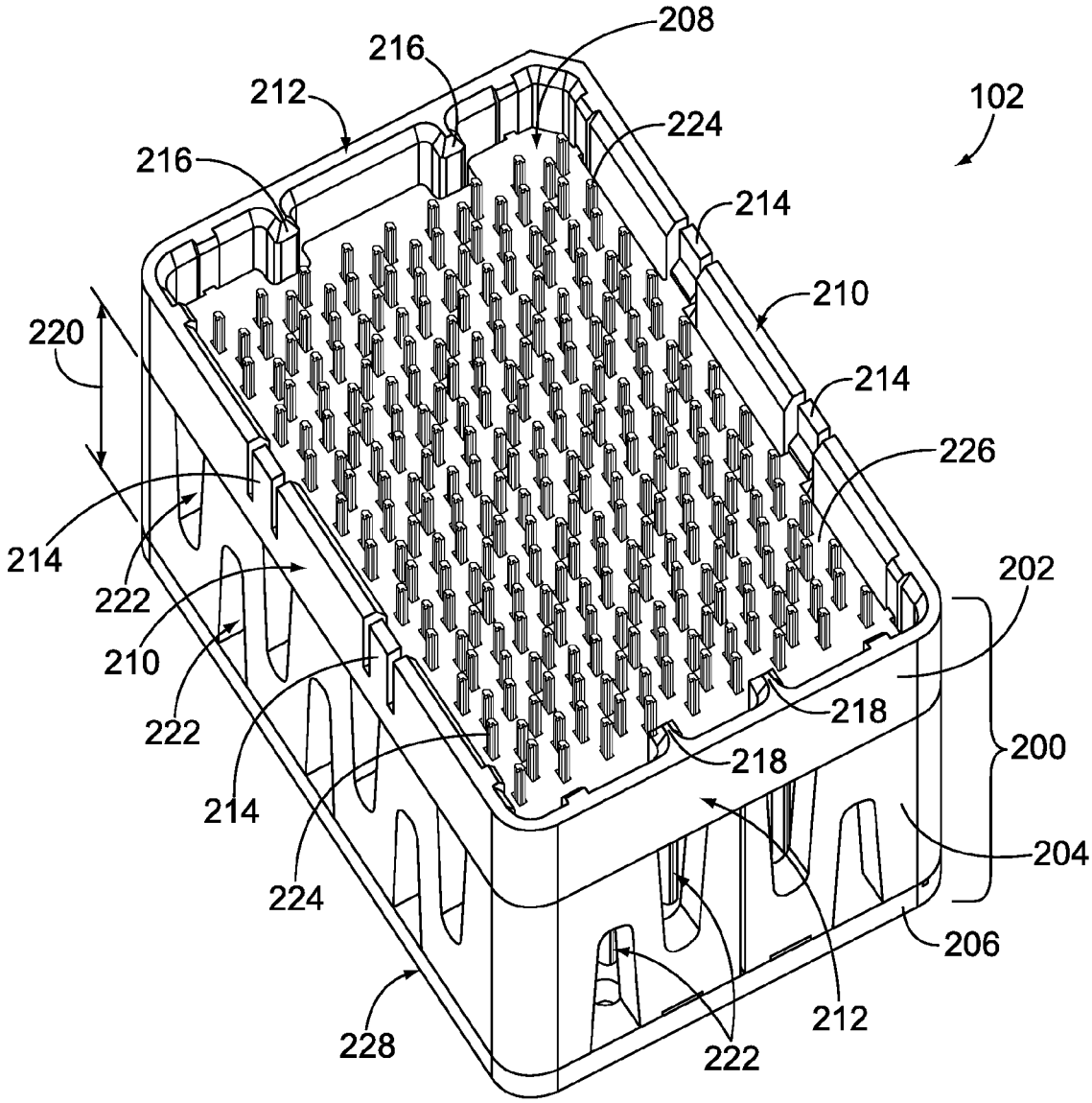
FIG. 2 is a perspective view of a header assembly shown in FIG. 1.

FIG. 2 is a perspective view of the header assembly 102. The header assembly 102 includes a housing 200 composed of a mounting body 206 and a mating body 202 interconnected by a spacer body 204. In one embodiment, the header assembly 102 includes a contact organizer 226 disposed proximate to the mating body 202. For example, the contact organizer 226 may be disposed adjacent to the mating body 202. One or more of the contact organizer 226 and the mating, spacer and mounting bodies 202-206 may be a unitary body. For example, one or more of the contact organizer 226 and the mating, spacer and mounting bodies 202-206 may be homogeneously formed of a dielectric material, such as a plastic material. The contact organizer 226 includes a mating interface 208. Alternatively, the mating body 202 includes the mating interface 208. The mating interface 208 engages the mating connector 108 (shown in FIG. 1) when the header assembly 102 is mated with the mating connector 108. In another embodiment, the mating interface 208 may engage the daughter board 106 (shown in FIG. 1). The mating body 202 includes a plurality of sidewalls 210 and a plurality of end walls 212. The sidewalls and end walls 210, 212 protrude from the header assembly 102 in a direction perpendicular to the mating interface 208. The sidewalls 210 and end walls 212 form a shroud in which at least a portion of the mating connector 108 is received when the header assembly 102 and the mating connector 108 mate with one another. The mounting body 206 includes a mounting interface 228. The mounting interface 228 engages the motherboard 104 (shown in FIG. 1) when the header assembly 102 is mounted to the motherboard 104.

The sidewalls 210 include latches 214 in the illustrated embodiment. The latches 214 engage the contact organizer 226 to mechanically secure the contact organizer 226 in the header assembly 102 between the end walls 212 and the sidewalls 210. Alternatively, one or more of the end walls 212 may include one or more latches 214. The end walls 212 include polarization features 216, 218 in the illustrated embodiment. The polarization features 216, 218 are shown as columnar protrusions that extend inward from the end walls 212. The polarization features 216, 218 are received in corresponding polarization slots 510, 512 (shown in FIG. 5) in the mating connector 108 to orient the mating connector 108 and the header assembly 102 with respect to one another. For example, the polarization features 216 may be disposed farther apart from one another when compared to the polarization features 218. The corresponding polarization slots 510, 512 in the mating connector 108 that receive the polarization features 216, 218 are disposed apart from one another such that the mating connector 108 and the header assembly 102 may only be mated in one orientation.

The spacer body 204 separates the mating and mounting bodies 202, 206 by a separation gap 220. The spacer body 204 extends between the mating and mounting bodies 202, 206 in a direction transverse to the mating and mounting bodies 202, 206. For example, the spacer body 204 may be perpendicular to the mating and mounting bodies 202, 206. In the illustrated embodiment, the spacer body 204 has a saw tooth shape with a plurality of openings 222 disposed therein. Alternatively, the spacer body 204 includes a different shape and/or a different number of openings 222. The openings 222 permit air to flow through the header assembly 102 between the mating and mounting bodies 202, 200. For example, air can enter the header assembly 102 through the openings 222 in the spacer body 204. The air can pass through the header assembly 102 between the mating and mounting bodies 202, 200 and exit the header assembly 102 through the openings 222. Permitting air to flow through the header assembly 102 provides an additional channel of air flow between the motherboard 104 and daughter board 106. Additional components (not shown) on the motherboard 104 and daughter board 106 can produce thermal energy, or heat. The air flow between the upper motherboard 104 and daughter board 106 may reduce this heat by cooling the components. The openings 222 though the header assembly 102 permit the air to flow through the header assembly 102 and prevent the header assembly 102 from overly restricting the air flow between the motherboard 104 and daughter board 106.

Thermal energy, or heat, may be generated inside the header assembly 102 as the header assembly 102 communicates signals between the motherboard 104 and the daughter board 106 (shown in FIG. 1). As the rate at which the signals are communicated increases, the heat that is generated may increase. In order to dissipate this heat, the openings 222 permit access to the interior of the header assembly 102. For example, the openings 222 permit air to flow between the mating and mounting bodies 202, 206 through the header assembly 102. One or more fans (not shown) or other components may generate the air flow through the header assembly 102.

The header assembly 102 includes a plurality of contacts 224. The contacts 224 protrude from the mating interface 208 to mate with the mating connector 108 (shown in FIG. 1). Alternatively, the signal contacts 210 may protrude from the mating body 202 to mate with the daughter board 106 (shown in FIG. 1). The contacts 224 protrude from the mounting body 206 to mate with the motherboard 104 (shown in FIG. 1). For example, the contacts 224 may mate with mating contacts 508 (shown in FIG. 5) of the mating connector 108 to provide an electrical connection between the header assembly 102 and the mating connector 108. A different number of contacts 224 than those shown in FIG. 2 may be provided. A portion of the contacts 224 may be exposed in the header assembly 102 between the mating and mounting bodies 202, 206. For example, a portion of the contacts 224 may be exposed to the atmosphere or air within the header assembly 102. Exposing portions of the contacts 224 within the separation gap 220 of the header assembly 102 may more easily permit the thermal energy or heat generated by the communication of signals using the contacts 224 to be dissipated.

Figure 4:
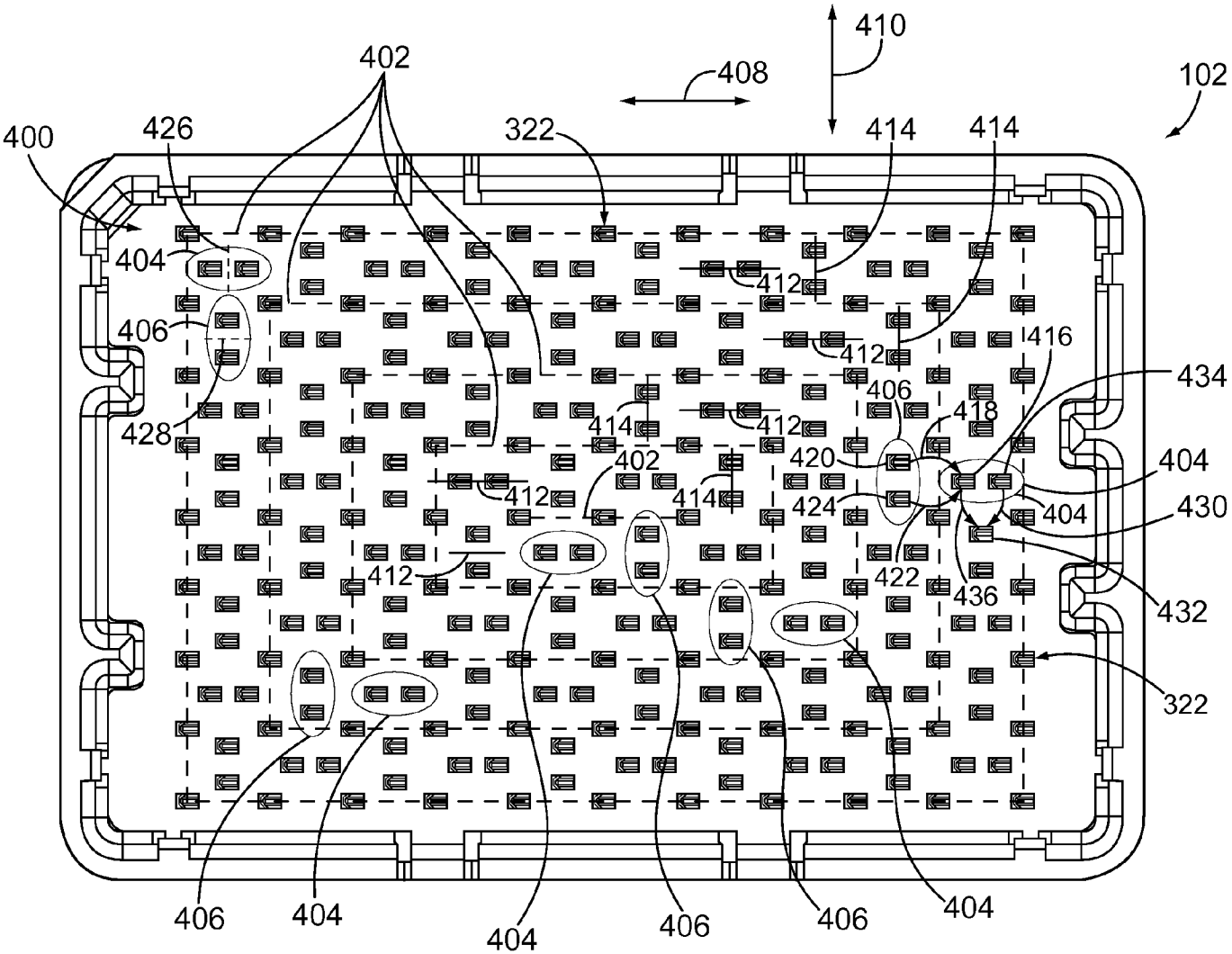
FIG. 4 is a top view of the header assembly shown in FIG. 1.

The contacts 224 may be arranged in a noise-reducing contact pattern 400 (shown in FIG. 4). As described below, the noise-reducing contact pattern 400 arranges the contacts 224 such that noise in the signals communicated by the contacts 224 and/or cross-talk in the signals communicated by the contacts 224 between the daughter board 106 (shown in FIG. 1) and the motherboard 104 (shown in FIG. 1.) is reduced. The noise-reducing contact pattern 400 extends through the connector assembly 100 (shown in FIG. 1) in one embodiment. For example, the noise-reducing contact pattern 400 may extend from the motherboard 104, through the mating connector 108 (shown in FIG. 1) and the header assembly 102, and to the daughter board 106. The noise-reducing contact pattern 400 may extend through the motherboard 104, mating connector 108, header assembly 102, and daughter board 106 such that the pattern is aligned through the mating connector 108 and the header assembly 102 in a direction transverse to the motherboard 104 and daughter board 106. Extending the noise-reducing contact pattern 400 throughout the connector assembly 100 may preserve the advantages gained by organizing the contacts 224 in the pattern 400. For example, preserving the arrangement of the contacts 224 throughout the connector assembly 100 may maintain the signal integrity advantages throughout the connector assembly 100. The signal integrity advantages may include the reduction of noise and cross-talk in the signals.

Figure 3:
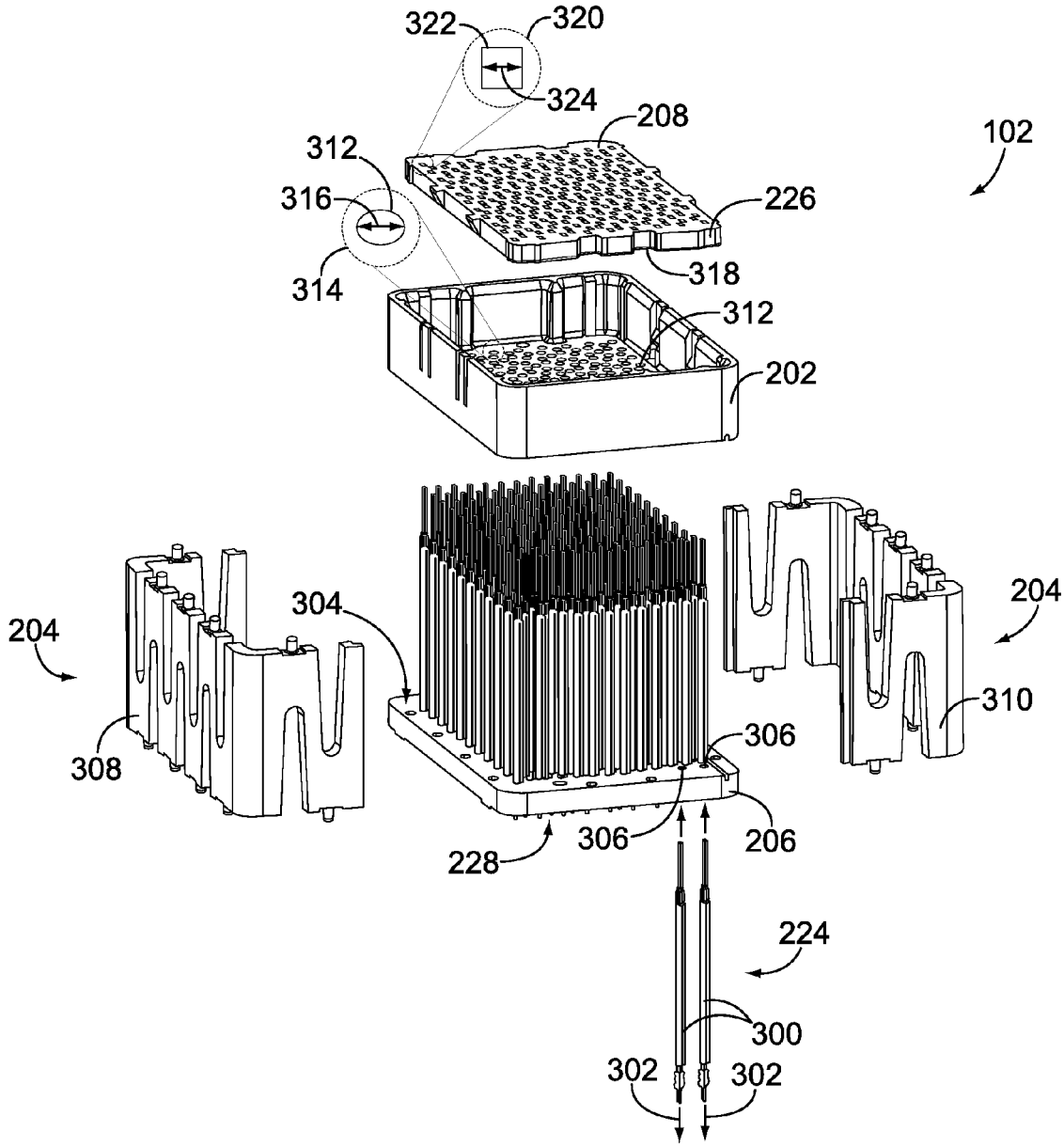
FIG. 3 is an exploded view of the header assembly shown in FIG. 1.

FIG. 3 is an exploded view of the header assembly 102. As shown in FIG. 3, the mating body 202, mounting body 206 and contact organizer 226 are substantially parallel with respect to one another in the illustrated embodiment. The contacts 224 have elongated bodies 300 oriented along longitudinal axes 302. The contacts 224 and the longitudinal axes 302 may be disposed transverse to the mating body 202, mounting body 206 and contact organizer 226. For example, the contacts 224 may be oriented perpendicular to the mating and mounting bodies 202, 206 and the contact organizer 226.

The mounting body 206 extends between the mounting interface 228 and a loading interface 304. The mounting and loading interfaces 228, 304 include mounting body openings 306 that extend through the mounting body 206. The contacts 224 are loaded into the mounting body openings 306 through the loading interface 304. Alternatively, the contacts 224 are loaded into the mounting body openings 306 through the mounting interface 228. The contacts 224 protrude from the mounting interface 228 in the illustrated embodiment. The spacer body 204 includes two body sections 308, 310. Alternatively, the spacer body 204 may include a different number of sections or be formed as a unitary body.

The mating body 202 includes mating body contact openings 312 that extend through the mating body 202. The contacts 224 are loaded through the mating body 202 through the mating body contact openings 312. The contact organizer 226 extends between a loading side 318 and the mating interface 208. Organizer contact openings 322 extend through the contact organizer 226 between the loading side 318 and the mating interface 208. The contacts 224 are loaded through the organizer contact openings 322 such that the contacts 224 at least partially protrude from the mating interface 208. Each of the mating body openings 312 and the organizer contact openings 322 include an inside dimension 316, 324. For example, as shown in the magnified views 314, 320, the inside dimensions 316, 324 extend across the insides of the mating body openings 312 and the organizer contact openings 322. The inside dimension 316 of the mating body opening 312 is larger than the inside dimension 324 of the organizer contact opening 322. The inside dimension 316 may be larger than the inside dimension 324 to permit greater tolerances in loading the contacts 224 through the mating body 202 prior to loading the contacts 224 through the contact organizer 226. Alternatively, the inside dimension 316 may be the same size as, or smaller than, the inside dimension 324.

FIG. 4 is a top view of the header assembly 102. As described above, the contacts 224 in the connector assembly 100 (shown in FIG. 1) may be arranged in the noise-reducing contact pattern 400. The contacts 224 may be held by the housing 200 (shown in FIG. 2) of the header assembly 102 such that the contacts 224 are held in the noise-reducing contact pattern 400 throughout the header assembly 102 between the mating and mounting interfaces 208, 228 (shown in FIG. 2). In one embodiment the contacts 224 are arranged in the noise-reducing contact pattern 400 such that the spacing and arrangement of the contacts 224 with respect to one another is substantially the same at various locations throughout the housing 200. For example, the spacing and arrangement of the contacts 224 with respect to one another may be the same in the mating and mounting interfaces 208, 228 and in each of a plurality of planes 122, 124, 126, 128 (shown in FIG. 1) that dissect the header assembly 102. The planes 122-128 may be parallel to the mating and mounting interfaces 226, 228.

In the illustrated embodiment, the noise-reducing contact pattern 400 includes a subset of the contacts 224 arranged in grounding rings 402 which are indicated by rings of dashed lines in FIG. 4. The grounding rings 402 include contacts 224 that are electrically connected to an electrical ground. For example, the contacts 224 in the grounding rings 402 may be electrically connected to an electrical ground of the motherboard 104 (shown in FIG. 1) when the header assembly 102 is mounted to the motherboard 104. The grounding rings 402 may include arrangements of the contacts 224 in shapes other than a ring. For example, at least one of the grounding rings 402 may include contacts 224 linearly arranged with respect to one another.

Another subset of the contacts 224 may be arranged in pairs 404, 406. The pairs 404 of contacts 224 are arranged in a horizontal direction 408 and the pairs 406 of contacts 224 are arranged in a transverse direction 410. In one embodiment, the transverse and horizontal directions 410, 408 are perpendicular to one another. The pairs 404, 406 each include contacts 224 arranged on a respective contact line 412, 414. The contact lines 412 for the pairs 404 may be transverse to the contact lines 414 for adjacent pairs 406. In one embodiment, the contact lines 412, 414 for adjacent pairs 404, 406 of contacts 224 are perpendicular to one another. The contacts 224 in the pairs 404, 406 are located on opposite sides of bisector axes 426, 428 in the pairs 404, 406. The bisector axis 426 is transverse to the contact line 412 in the pairs 404 and the bisector axis 428 is transverse to the contact line 414 in the pairs 406. For example, the bisector axis 426 may be perpendicular to the contact line 412 and the bisector axis 428 may be perpendicular to the contact line 416. In the illustrated embodiment, the bisector axis 426 of the pairs 404 is collinear with the contact line 414 of one or more adjacent pairs 406 and the bisector axis 428 of the pairs 406 is collinear with the contact line 412 of one or more adjacent pairs 404. As a result, a contact 416 in one of the pairs 404 may be equidistant from contacts 420, 424 in one of the pairs 406.

The contacts 224 in the pairs 404, 406 in the noise-reducing pattern 400 communicate differential pair signals in one embodiment. For example, the contacts 224 in the pairs 404, 406 may communicate differential pair signals in each pair 404, 406. Alternatively, the contacts 224 in the pairs 404, 406 may communicate a signal other than a differential pair signal. As described above, the contacts 224 extend through the organizer contact openings 322, the mating body contact openings 312 (shown in FIG. 3) and the mounting body openings 306 (shown in FIG. 3) in one embodiment. In order to maintain the contacts 224 in the noise-reducing pattern 400, the organizer contact openings 322, the mating body contact openings 312 and the mounting body openings 306 may be arranged in the noise-reducing pattern 400.

The arrangement of the contacts 224 in the pattern 400 throughout the header assembly 102 may reduce noise and/or cross-talk between the contacts 224. Differential signals passing through the contacts 224 in the pairs 404, 406 may form electromagnetic fields (EMF). For example, one contact 416 in a pair 404 may be in the presence of an EMF+ 418 that is generated by another contact 420 in another pair 406. The contact 416 also is in the presence of an EMF– 422 that is generated by the contact 424 in the pair 406 with the contact 420. Because the contacts 420, 424 in the pair 406 may communicate a differential pair signal with equal and opposite, or inverse, signals and because the contact 416 may be equidistant from the contacts 420, 424, the EMF 418 may cancel or reduce the EMF 422 at the contact 416. The net effect of the EMF 418 and the EMF 422 at the contact 416 may be reduced. For example, the net effect of the EMF 418, 422 may be zero. Similarly, the net effect of the EMF 418, 422 at another contact 434 in the pair 404 with the contact 416 may be reduced or eliminated. The noise and/or cross-talk generated at the contacts 416, 434 due to the EMF 418, 422 created by the contacts 420, 424 may be sell reducing or canceling with the net effect on the signal component carried at the contacts 416, 434 being reduced or eliminated. In a similar manner, EMF 436, 430 generated by the contacts 416, 434 in the pair 404 may be self-reducing or self-canceling at a contact 432 in a pair 406.

Figure 5:
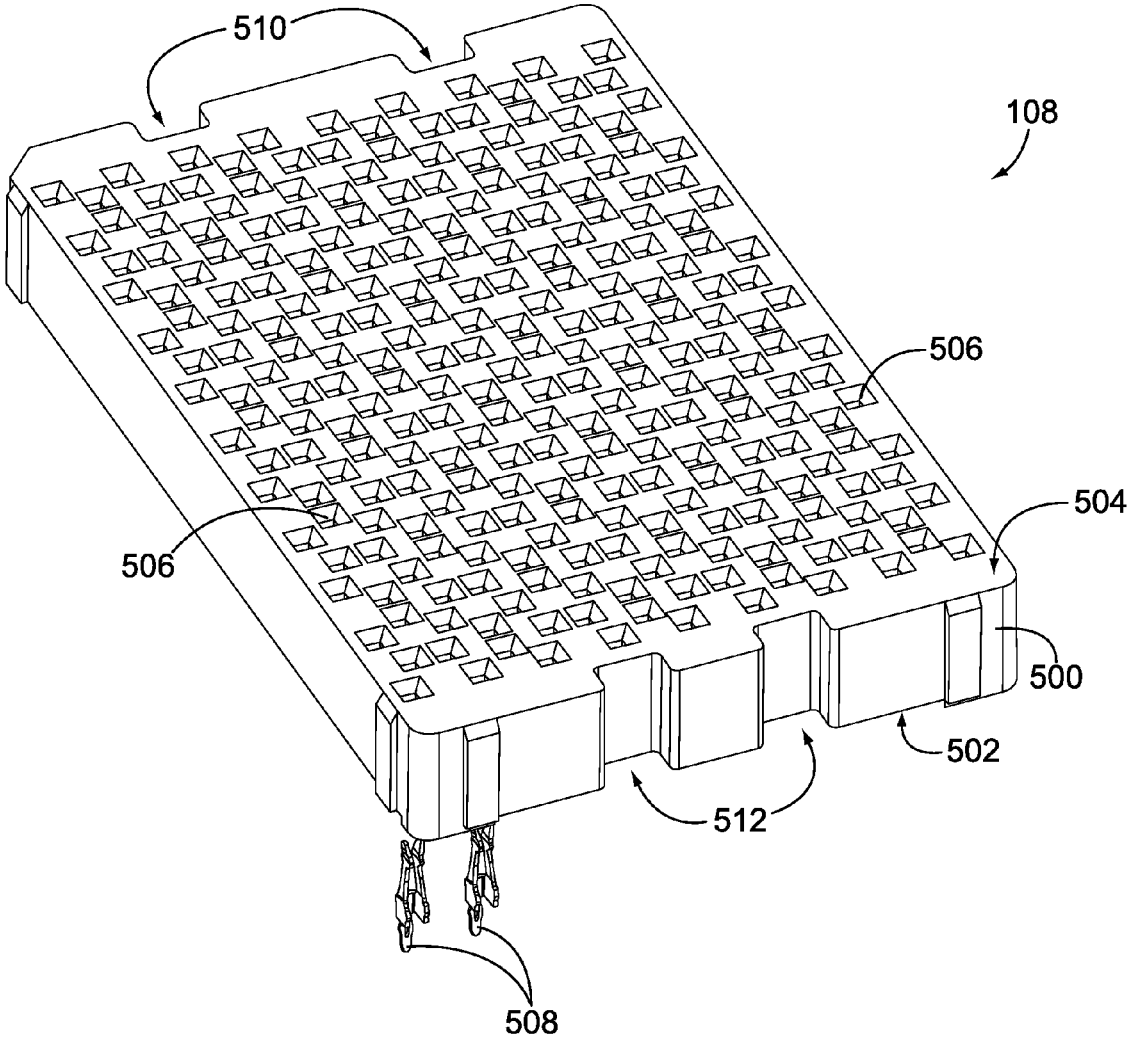
FIG. 5 is a perspective view of a mating connector shown in FIG. 1.

FIG. 5 is a perspective view of the mating connector 108. The mating connector 108 includes a connector body 500 that extends between a mounting interface 502 and a mating interface 504. The body 500 may be a unitary body. For example, the body 500 may be homogeneously formed from a dielectric material. The mounting interface 502 engages the daughter board 106 (shown in FIG. 1) when the mating connector 108 is mounted to the daughter board 106. The mating interface 504 engages the header assembly 102 (shown in FIG. 1) when the header assembly 102 and the mating connector 108 mate with one another. For example, the mating interface 504 of the mating connector 108 may engage the mating interface 208 (shown in FIG. 2) of the header assembly 102.

The body 500 includes contact cavities 506 that receive the contacts 224 (shown in FIG. 2) to electrically connect the mating connector 108 and the header assembly 102 (shown in FIG. 1). Mating contacts 508 may be disposed in the contact cavities 506. The mating contacts 508 may be loaded into the contact cavities 506 through the mounting interface 502. The mating contacts 508 electrically connect with the contacts 224 in the header assembly 102 to electrically connect the header assembly 102 and the mating connector 108. The contact cavities 506 may be arranged in the noise-reducing contact pattern 400 (shown in FIG. 4). For example, in order for the contact cavities 506 to receive the contacts 224 in the header assembly 102, the contact cavities 506 may be arranged in the same pattern 400 as the contacts 224.

The body 500 includes polarization slots 510, 512. The polarization slots 510 are shaped and disposed in the body 500 to receive the polarization features 216 (shown in FIG. 2) of the header assembly 102 (shown in FIG. 1). The polarization slots 512 are shaped and disposed in the body 500 to receive the polarization features 218 (shown in FIG. 2) of the header assembly 102. The polarization slots 510, 512 receive the polarization features 216, 218 to align the mating connector 108 and the header assembly 102 with respect to one another.

Figure 6:
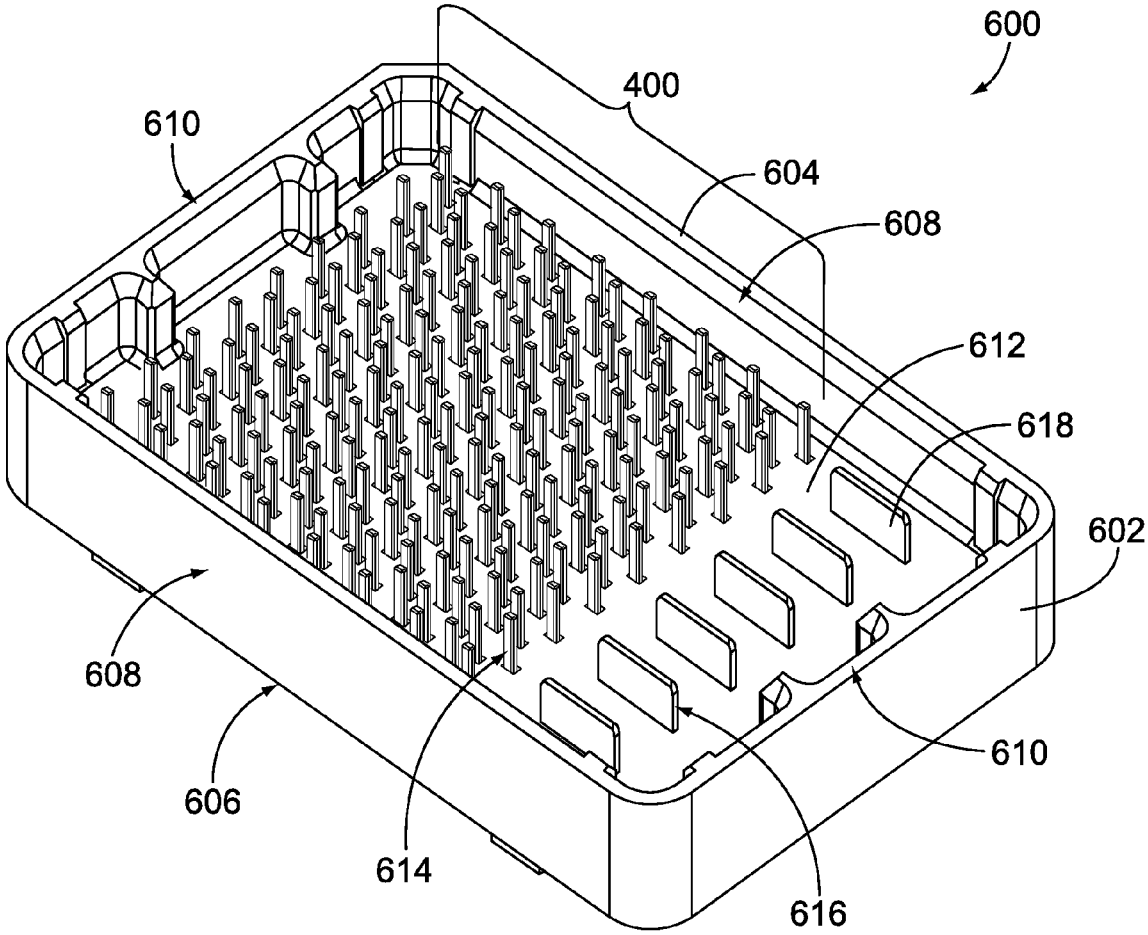
FIG. 6 is a perspective view of a header assembly according to an alternative embodiment.

FIG. 6 is a perspective view of a header assembly 600 according to an alternative embodiment. The header assembly 600 includes a housing 602 that extends between a mating face 604 and a mounting interlace 606. The housing 602 may be a unitary body. For example, the housing 602 may be homogeneously formed of a dielectric material, such as a plastic material. A contact organizer 612 is held in the housing 602 between sidewalls 608 and end walls 610 of the housing 602. The contact organizer 612 engages the mating connector 108 (shown in FIG. 1) similar to the contact organizer 226 (shown in FIG. 2). Signal contacts 614 and power contacts 616 extend through the housing 602 similar to the signal contacts 224 (shown in FIG. 2). The signal contacts 614 may be arranged in the noise-reducing contact pattern 400 described above in connection with FIG. 4. The power contacts 616 include a substantially planar body 618 and are configured to communicate electric power between the motherboard 104 and daughter board 106 (shown in FIG. 1). Unlike the header assembly 102 (shown in FIG. 1), the header assembly 600 does not include a spacer body. For example, the mating face 604 and the mounting interface 606 are not separated by a gap that permits air to flow through the header assembly 600. The header assembly 600 may provide a smaller profile or smaller stack height 110 (shown in FIG. 1) between the motherboard 104 and daughter board 106 than the header assembly 102.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. A connector assembly comprising:

a connector configured to mate with a circuit board, the connector including a housing extending between mating and mounting interfaces and including a mating body and a mounting body with a gap extending between the mating body and the mounting body, the mating body comprising the mating interface and the mounting body comprising the mounting interface, the mating and mounting interfaces having contact openings in a noise-reducing contact pattern, the contact openings in the pattern arranged in pairs along respective contact lines, the contact lines of adjacent pairs being transverse to one another; and contacts extending through the contact openings and arranged in the noise-reducing contact pattern through the housing between the mating and mounting interfaces to reduce at least one of electric noise and cross-talk in signals communicated by the contacts.

2. The connector assembly of claim 1, wherein the contacts are arranged in the pattern to communicate differential pair signals.

3. The connector assembly of claim 1, wherein the pattern comprises a subset of the contacts arranged in the pairs and a second subset of the contacts arranged in a grounding ring, the contacts in the first subset oriented along the contact lines, the contacts in the second subset electrically connected to an electrical ground.

4. The connector assembly of claim 1, wherein the contact openings in the mating and mounting interfaces are aligned with respect to one another in a direction transverse to the mounting and mating interfaces.

5. The connector assembly of claim 1, wherein the contacts have elongated bodies arranged in the pattern throughout the housing between the mating and mounting interfaces.

6. The connector assembly of claim 1, wherein the housing is configured to interconnect substrates in a parallel relationship, the contacts electrically connecting the substrates to communicate the signals between the substrates.

7. The connector assembly of claim 1, wherein the mating and mounting interfaces are parallel with respect to one another and configured to engage substrates, the contacts electrically connecting the substrates.

8. The connector assembly of claim 1, wherein the contacts comprise elongated bodies extending along longitudinal axes, the longitudinal axes disposed transverse to the mating and mounting interfaces.

9. The connector assembly of claim 1, further comprising a contact organizer comprising organizer openings arranged in the pattern and aligned with the contact openings in the housing.

10. The connector assembly of claim 9, wherein the contact openings have greater inside dimensions than the organizer openings.

11. A connector assembly for electronically and mechanically coupling substrates with one another, the connector assembly comprising:

a header assembly including a housing and mezzanine contacts, the housing extending between mating and mounting interfaces, the mounting interface configured to be mounted to one of the substrates, the mating and mounting interfaces having contact openings in a noise-reducing contact pattern, the contact openings in the pattern arranged in pairs along respective contact lines, the contact lines of adjacent pairs being transverse to one another, the mezzanine contacts extending through the contact openings and arranged in the noise-reducing contact pattern through the header assembly between the mating and mounting interfaces to reduce at least one of electric noise and cross-talk in signals communicated by the mezzanine contacts; and a mating connector configured to be mounted to another one of the substrates and to mate with the mating interface of the header assembly, the mating connector comprising mating contacts arranged in the noise-reducing contact pattern to mate with the mezzanine contacts, wherein the header assembly and the mating connector mate with one another to electrically connect the substrates.

12. The connector assembly of claim 11, wherein the mezzanine and mating contacts are arranged in the pattern to communicate differential pair signals.

13. The connector assembly of claim 11, wherein the pattern comprises a subset of the mezzanine and mating contacts arranged in the pairs and a second subset of the mezzanine and mating contacts arranged in grounding rings, the mezzanine and mating contacts in the first subset oriented along the contact lines, the mezzanine and mating contacts in the second subset electrically connected to an electrical ground.

14. The connector assembly of claim 11, wherein the mezzanine and mating contacts are aligned with respect to one another in a direction transverse to the substrates when the header assembly and the mating connector mate with the substrates.

15. The connector assembly of claim 11, wherein the header assembly and the mating connector are configured to interconnect the substrates in a parallel relationship.

16. The connector assembly of claim 11, wherein the contacts have elongated bodies arranged in the pattern throughout the header assembly between the mating and mounting interfaces.

17. The connector assembly of claim 11, wherein the mezzanine contacts comprise elongated bodies extending along longitudinal axes, the longitudinal axes disposed transverse to the substrates when the header assembly and the mating connector interconnect the substrates.

18. The connector assembly of claim 11, further comprising a contact organizer disposed proximate to the mating interface of the header assembly, the contact organizer comprising organizer openings arranged in the pattern and aligned with the contact openings in the header assembly and the mating connector.

19. The connector assembly of claim 18, wherein the contact openings in the header assembly have greater inside dimensions than the organizer openings in the contact organizer.

* * * * *